US007967374B2

(12) United States Patent
Akkad

(10) Patent No.: US 7,967,374 B2
(45) Date of Patent: Jun. 28, 2011

(54) FOLDABLE CHAIR

(75) Inventor: Benjamin S. Akkad, Brooklyn, NY (US)

(73) Assignee: Idea Nuova, Inc., New York, NY (US)

( * ) Notice: Subject to any disclaimer, the term of this patent is extended or adjusted under 35 U.S.C. 154(b) by 0 days.

(21) Appl. No.: 12/544,256

(22) Filed: Aug. 20, 2009

(65) Prior Publication Data

US 2011/0043004 A1 Feb. 24, 2011

(51) Int. Cl.

| | |
|---|---|
| ***A47C 4/00*** | (2006.01) |
| ***A47C 4/24*** | (2006.01) |
| ***A47C 4/06*** | (2006.01) |
| ***A47C 4/10*** | (2006.01) |
| ***A47C 4/14*** | (2006.01) |
| ***A47C 4/18*** | (2006.01) |
| ***A47C 4/20*** | (2006.01) |

(52) U.S. Cl. ..... 297/42; 297/16.1; 297/16.2; 297/45; 297/46; 297/52; 297/56

(58) Field of Classification Search ..... 297/45, 297/46, 52, 56, 16.1, 16.2, 42
See application file for complete search history.

(56) References Cited

U.S. PATENT DOCUMENTS

| | | | | |
|---|---|---|---|---|
| 244,216 | A | 7/1881 | Fenby | |
| 398,943 | A | 3/1889 | Crandall | |
| 509,735 | A * | 11/1893 | Hanson | 297/42 |
| 615,476 | A | 12/1898 | Chapman | |
| 1,027,692 | A | 5/1912 | Cole | |
| 1,185,568 | A | 5/1916 | Zeunert | |
| 1,263,717 | A | 4/1918 | Stone | |
| 1,443,734 | A * | 1/1923 | Craig | 297/46 |
| 1,939,743 | A | 12/1933 | Warner | |
| 1,942,112 | A | 1/1934 | McQuilkin | |
| 2,381,574 | A | 8/1945 | Clarin | |
| 2,473,090 | A | 6/1949 | Becker | |
| 2,587,543 | A | 2/1952 | Smith | |
| D171,176 | S | 12/1953 | Yellen | |
| 2,691,410 | A | 10/1954 | Boucher | |
| 2,712,349 | A | 7/1955 | LeVoir | |
| 2,713,890 | A | 7/1955 | Mack | |
| 2,733,755 | A | 2/1956 | Boucher | |
| D180,210 | S | 4/1957 | Uretsky | |

(Continued)

FOREIGN PATENT DOCUMENTS

| | | | |
|---|---|---|---|
| CN | 87201431 | U | 2/1988 |

(Continued)

*Primary Examiner* — Rodney B White
(74) *Attorney, Agent, or Firm* — Panitch Schwarze Belisario & Nadel LLP

(57) ABSTRACT

A chair that is reconfigurable between a folded and an unfolded configuration includes a first leg having a first end and an opposite second end. An intermediate portion is located between the first and second ends. A second leg has a first end and an opposite second end. An intermediate portion is located between the first and second ends of the second leg. The intermediate portion of the second leg is pivotally connected to the intermediate portion of the first leg. A support member has a first end pivotally connected to the first leg and an opposite second end. A seat frame has a first part pivotally connected to the second end of the support member and a second part pivotally connected to the second end of the second leg. The second end of the support member is adjacent the first end of both the first and second legs in the folded configuration.

12 Claims, 6 Drawing Sheets

U.S. PATENT DOCUMENTS

| | | | | |
|---|---|---|---|---|
| 2,902,084 | A | 9/1959 | Stevens | |
| 3,123,396 | A | 3/1964 | Searle | |
| 3,124,387 | A | 3/1964 | MacLaren | |
| 3,136,272 | A | 6/1964 | Sprigman | |
| 3,635,520 | A | 1/1972 | Roher et al. | |
| 3,838,883 | A | 10/1974 | Machen | |
| 3,941,416 | A | 3/1976 | Uchida | |
| 4,045,045 | A | 8/1977 | Boucher et al. | |
| 4,047,752 | A | 9/1977 | Rohr | |
| 4,105,244 | A | 8/1978 | Colby | |
| 4,118,065 | A | 10/1978 | Watkins | |
| 4,193,630 | A | 3/1980 | Steele | |
| 4,231,582 | A | 11/1980 | Moss | |
| 4,258,951 | A | 3/1981 | Groom | |
| 4,290,643 | A | 9/1981 | Logan, III | |
| D262,674 | S | 1/1982 | Logan, III | |
| D267,057 | S | 11/1982 | Koehm | |
| 4,514,009 | A | 4/1985 | Vanderminden et al. | |
| 4,605,261 | A | 8/1986 | Lee | |
| 4,652,047 | A | 3/1987 | Chan | |
| D290,557 | S | 6/1987 | Salvati et al. | |
| 4,671,566 | A | 6/1987 | Knapp et al. | |
| 4,685,725 | A | 8/1987 | Helfrich | |
| 4,715,650 | A | 12/1987 | Berman et al. | |
| 4,717,201 | A | 1/1988 | Barras | |
| 4,789,123 | A | 12/1988 | Mattsson | |
| 4,826,241 | A | 5/1989 | Barras | |
| 4,867,505 | A | 9/1989 | Parker | |
| 4,889,383 | A | 12/1989 | Jones | |
| 4,934,638 | A | 6/1990 | Davis | |
| D310,605 | S | 9/1990 | Kwon | |
| 5,058,950 | A | 10/1991 | Mann | |
| 5,176,393 | A | 1/1993 | Robertson et al. | |
| 5,246,265 | A | 9/1993 | Nagan et al. | |
| 5,320,404 | A | 6/1994 | Le Gal | |
| 5,335,967 | A | 8/1994 | Vanderminden, Sr. | |
| 5,494,333 | A | 2/1996 | Wilson | |
| 5,499,857 | A | 3/1996 | Lynch, Jr. | |
| 5,522,642 | A | 6/1996 | Herzog | |
| 5,580,129 | A | 12/1996 | Findlay | |
| D380,306 | S | 7/1997 | Lin | |
| D382,126 | S | 8/1997 | Lee | |
| D382,414 | S | 8/1997 | Lee | |
| 5,718,473 | A * | 2/1998 | Lynch, Jr. | 297/45 X |
| 5,848,822 | A | 12/1998 | Wu | |
| 5,893,605 | A | 4/1999 | Chang | |
| D411,387 | S | 6/1999 | Zheng | |
| 5,979,976 | A | 11/1999 | Ferencik | |
| 5,984,406 | A | 11/1999 | Lee | |
| 6,045,177 | A | 4/2000 | Grace | |
| 6,056,354 | A | 5/2000 | Tseng | |
| 6,082,813 | A | 7/2000 | Chen | |
| 6,095,607 | A | 8/2000 | Wenzel | |
| 6,112,757 | A | 9/2000 | Tseng | |
| D431,382 | S | 10/2000 | Eloge et al. | |
| D432,325 | S | 10/2000 | Zheng et al. | |
| D432,823 | S | 10/2000 | Zheng | |
| D433,244 | S | 11/2000 | Zheng | |
| D433,574 | S | 11/2000 | Zheng | |
| 6,149,238 | A | 11/2000 | Tsai | |
| 6,179,374 | B1 | 1/2001 | Tang | |
| 6,209,951 | B1 | 4/2001 | Han | |
| 6,231,119 | B1 | 5/2001 | Zheng | |
| 6,237,993 | B1 | 5/2001 | Zheng | |
| 6,238,001 | B1 | 5/2001 | Yoran | |
| 6,241,311 | B1 | 6/2001 | Zheng | |
| 6,247,748 | B1 | 6/2001 | Zheng | |
| 6,264,271 | B1 | 7/2001 | Munn et al. | |
| 6,283,046 | B1 | 9/2001 | Tseng | |
| 6,296,304 | B1 | 10/2001 | Zheng | |
| 6,302,479 | B1 | 10/2001 | Zheng | |
| 6,322,138 | B1 | 11/2001 | Tang | |
| 6,332,646 | B1 | 12/2001 | Tseng | |
| 6,354,657 | B1 | 3/2002 | Nelson et al. | |
| 6,364,411 | B1 | 4/2002 | Zheng | |
| 6,371,553 | B1 | 4/2002 | Tang | |
| D456,628 | S | 5/2002 | Satoshi | |
| 6,382,715 | B1 | 5/2002 | Tang | |
| 6,382,729 | B1 | 5/2002 | Wu | |
| 6,402,230 | B1 | 6/2002 | Tang | |
| D460,280 | S | 7/2002 | Fox | |
| 6,419,311 | B1 | 7/2002 | Tang | |
| 6,447,057 | B1 | 9/2002 | Chen | |
| 6,454,348 | B1 | 9/2002 | Wu | |
| 6,488,331 | B2 | 12/2002 | Chen | |
| 6,494,530 | B1 | 12/2002 | Zheng | |
| D468,939 | S | 1/2003 | Zheng | |
| 6,505,885 | B1 | 1/2003 | Tang | |
| 6,547,322 | B2 | 4/2003 | Marx | |
| 6,601,912 | B1 | 8/2003 | Chen | |
| 6,607,240 | B2 | 8/2003 | Zheng | |
| 6,629,722 | B1 | 10/2003 | Tang | |
| 6,634,705 | B1 | 10/2003 | Zheng | |
| 6,637,811 | B2 | 10/2003 | Zheng | |
| 6,644,731 | B2 | 11/2003 | Tang | |
| 6,669,281 | B1 | 12/2003 | Huang | |
| 6,682,135 | B2 | 1/2004 | Zheng | |
| D486,310 | S | 2/2004 | Goldy | |
| 6,698,827 | B2 | 3/2004 | Le Gette et al. | |
| 6,702,371 | B2 | 3/2004 | Zheng | |
| 6,715,824 | B2 | 4/2004 | Zheng | |
| 6,736,450 | B2 | 5/2004 | Miyagi | |
| 6,755,462 | B2 | 6/2004 | Zheng | |
| 6,779,838 | B2 | 8/2004 | Chang | |
| 6,814,403 | B2 | 11/2004 | Zheng | |
| 6,817,661 | B2 | 11/2004 | Zheng | |
| 6,817,671 | B1 | 11/2004 | Zheng | |
| 6,820,927 | B2 | 11/2004 | Isom et al. | |
| 6,824,207 | B1 * | 11/2004 | Lin | 297/46 X |
| 6,824,208 | B2 | 11/2004 | Zheng | |
| 6,824,210 | B2 | 11/2004 | Zheng | |
| D500,605 | S | 1/2005 | Schmidt et al. | |
| 6,840,574 | B1 | 1/2005 | Wu | |
| 6,848,740 | B1 * | 2/2005 | Reese | 297/45 X |
| D503,554 | S | 4/2005 | Kay | |
| 6,899,383 | B2 | 5/2005 | Hwang | |
| D507,892 | S | 8/2005 | Zheng | |
| 6,926,355 | B2 | 8/2005 | Le Gette et al. | |
| 6,926,356 | B2 | 8/2005 | Chen | |
| 6,957,852 | B1 * | 10/2005 | Hsieh | 297/46 |
| D515,830 | S | 2/2006 | Zheng | |
| 6,997,634 | B2 * | 2/2006 | Zheng | 297/45 X |
| 7,000,983 | B1 | 2/2006 | Tsai | |
| D516,825 | S | 3/2006 | Zheng | |
| D516,826 | S | 3/2006 | Zheng | |
| D517,819 | S | 3/2006 | Zheng | |
| 7,011,372 | B1 * | 3/2006 | Hsieh | 297/45 X |
| 7,017,985 | B2 | 3/2006 | Chen | |
| D522,263 | S | 6/2006 | Hart | |
| 7,073,852 | B1 | 7/2006 | Zheng | |
| 7,100,877 | B2 | 9/2006 | Bourke et al. | |
| 7,100,975 | B1 | 9/2006 | Zheng | |
| D529,304 | S | 10/2006 | Le Gal | |
| D529,728 | S | 10/2006 | Le Gal | |
| 7,140,689 | B2 | 11/2006 | Zheng | |
| 7,144,078 | B2 | 12/2006 | Hsieh | |
| 7,178,864 | B2 * | 2/2007 | Hsieh | 297/45 |
| 7,219,955 | B2 | 5/2007 | Lu et al. | |
| 7,229,128 | B2 | 6/2007 | Lee | |
| 7,229,131 | B2 | 6/2007 | Chen | |
| 7,328,940 | B2 | 2/2008 | Zheng | |
| 7,396,073 | B2 | 7/2008 | Zheng | |
| 7,404,601 | B2 | 7/2008 | Chen | |
| 7,441,287 | B2 | 10/2008 | Zheng | |
| 7,600,810 | B2 * | 10/2009 | Chen et al. | 297/56 |
| 2002/0024240 | A1 | 2/2002 | Chen | |
| 2002/0043822 | A1 | 4/2002 | Choi et al. | |
| 2002/0074834 | A1 | 6/2002 | Summar et al. | |
| 2003/0006632 | A1 | 1/2003 | Ku | |
| 2003/0015892 | A1 | 1/2003 | Wu | |
| 2003/0020304 | A1 | 1/2003 | Zheng | |
| 2003/0052518 | A1 | 3/2003 | Zheng | |
| 2003/0057741 | A1 | 3/2003 | Zheng | |
| 2003/0094836 | A1 | 5/2003 | Chen | |
| 2003/0111872 | A1 | 6/2003 | Zheng | |
| 2003/0111874 | A1 | 6/2003 | Zheng | |
| 2003/0127885 | A1 | 7/2003 | Tang | |

| | | | | |
|---|---|---|---|---|
| 2003/0234561 | A1 | 12/2003 | Zheng | |
| 2004/0007903 | A1 | 1/2004 | Chang | |
| 2004/0036323 | A1 | 2/2004 | Hwang | |
| 2004/0066075 | A1 | 4/2004 | Yeh | |
| 2004/0094996 | A1 | 5/2004 | Zheng | |
| 2004/0094997 | A1 | 5/2004 | Zheng | |
| 2004/0113476 | A1 | 6/2004 | Chang | |
| 2004/0130190 | A1 | 7/2004 | Zheng | |
| 2004/0135405 | A1 | 7/2004 | Zheng | |
| 2004/0232740 | A1 | 11/2004 | Enge | |
| 2004/0245810 | A1 | 12/2004 | Tseng | |
| 2005/0077758 | A1 | 4/2005 | Reese | |
| 2005/0088018 | A1 | 4/2005 | Yao | |
| 2005/0236873 | A1 | 10/2005 | Edward | |
| 2005/0248202 | A1 | 11/2005 | Zheng | |
| 2006/0186711 | A1* | 8/2006 | Phipps | 297/46 |
| 2007/0029846 | A1 | 2/2007 | Cohen | |
| 2007/0102974 | A1 | 5/2007 | Chen | |
| 2007/0187998 | A1 | 8/2007 | Chen | |
| 2007/0200395 | A1 | 8/2007 | Zheng | |
| 2007/0267901 | A1 | 11/2007 | Zheng | |
| 2008/0224504 | A1 | 9/2008 | Fargason | |
| 2008/0231088 | A1 | 9/2008 | Zheng | |
| 2010/0164256 | A1* | 7/2010 | Salisbury | 297/16.2 |

FOREIGN PATENT DOCUMENTS

| | | | |
|---|---|---|---|
| CN | 2103938 | U | 5/1992 |
| CN | 2117779 | U | 10/1992 |
| CN | 2137107 | Y | 6/1993 |
| CN | 2179041 | Y | 10/1994 |
| CN | 2188885 | Y | 2/1995 |
| CN | 2196945 | Y | 5/1995 |
| CN | 1139537 | A | 1/1997 |
| CN | 2326083 | Y | 6/1999 |
| CN | 2328266 | Y | 7/1999 |
| CN | 2339063 | Y | 9/1999 |
| CN | 2349884 | Y | 11/1999 |
| CN | 2367154 | Y | 3/2000 |
| EP | 139306 | A1 | 5/1985 |
| EP | 997090 | A1 | 5/2000 |
| FR | 2833824 | A1 | 6/2003 |
| FR | 2837081 | A1 | 9/2003 |
| GB | 599760 | A | 3/1948 |
| GB | 2022405 | A | 12/1979 |
| GB | 2025213 | A | 1/1980 |
| GB | 2331233 | A | 5/1999 |
| JP | 3812532 | | 6/1938 |
| JP | 50123508 | A | 9/1975 |
| JP | 51127856 | A | 11/1976 |
| JP | 55120347 | A | 9/1980 |
| JP | 2001070077 | A | 3/2001 |
| JP | 2002165667 | A | 6/2002 |
| JP | 2002233429 | A | 8/2002 |
| JP | 2002360371 | A | 12/2002 |
| JP | 2004105557 | A | 4/2004 |
| WO | WO 2004/021835 | A1 | 3/2004 |

* cited by examiner

FOLDABLE CHAIR

BACKGROUND OF THE INVENTION

The present invention generally relates to a foldable chair and, more particularly, to a chair reconfigurable between a folded configuration for storage and an unfolded configuration for supporting an individual above a support surface.

Foldable chairs are well known in the art to provide easy displacement and compact storage during non-use. Some conventional foldable chairs include one or more separable components to allow the chair to have a relatively compact configuration for storage. Unfortunately, the separable components can be inadvertently misplaced and the relatively intricate components that are removably attachable can be easily damaged. Other conventional foldable chairs have telescoping members that allow for a relatively compact storage configuration. Unfortunately, such a configuration can be relatively expensive to produce and pieces of clothing and/or skin can be inadvertently caught in between the sliding telescoping members. Further, it can be difficult to determine when the telescoping members are properly "locked" in a position capable of supporting an individual in an unfolded configuration and, therefore, such foldable chairs can be problematic for a user.

Therefore, it would be desirable to provide a foldable chair that overcomes the above-identified disadvantages. Specifically, it would be desirable to provide a chair having several pivotable, yet permanently attached, components such that the chair is easily reconfigurable between a folded, compact storage configuration and an unfolded use configuration. It would be desirable to produce such a structurally-strong chair in a relatively inexpensive manner

BRIEF SUMMARY OF THE INVENTION

Briefly stated, the present invention is directed to a chair that is reconfigurable between a folded configuration for storage and an unfolded configuration for supporting an individual above a support surface. The chair includes a first leg having a first end for supporting the chair on the support surface in the unfolded configuration and an opposite second end extending upwardly and rearwardly from the first end in the unfolded configuration. An intermediate portion is located between the first and second ends. A second leg has a first end for supporting the chair on the support surface in the unfolded configuration and an opposite second end extending upwardly and forwardly from the first end in the unfolded configuration. An intermediate portion of the second leg is located between the first and second ends of the second leg. The intermediate portion of the second leg is pivotally connected to the intermediate portion of the first leg. A support member has a first end pivotally connected to the first leg and an opposite second end. A seat frame has a first part pivotally connected to the second end of the support member and a second part pivotally connected to the second end of the second leg. The second end of the support member is adjacent the first end of both the first and second legs in the folded configuration.

In another aspect, the present invention is directed to a chair that includes a first leg having a first end for supporting the chair on a support surface in an unfolded configuration and an opposite second end extending upwardly and rearwardly from the first end in the unfolded configuration. An intermediate portion is located between the first and second ends. A second leg has a first end for supporting the chair on the support surface in the unfolded configuration and an opposite second end extending upwardly and forwardly from the first end in the unfolded configuration. An intermediate portion of the second leg is located between the first and second ends of the second leg. The intermediate portion of the second leg is pivotally connected to the intermediate portion of the first leg. A support member has a first end pivotally connected to the first leg and an opposite second end. A bracket pivotally attaches a portion of the first leg to the support member. A first end of the bracket surrounds a portion of the first leg between the intermediate portion and the second end of the first leg. A second end of the bracket is pivotally connected to the support member proximate the first end thereof. A seat frame has a first part pivotally connected to the second end of the support member and a second part pivotally connected to the second end of the second leg. A seat is supported by the seat frame. The chair is reconfigurable between a folded configuration for storage where the legs and support member are pivoted to be generally flat and proximate to a plane defined by the seat frame and the unfolded configuration for supporting an individual above the support surface. The second end of the support member is adjacent the first end of both the first and second legs in the folded configuration.

In yet another aspect, the present invention is directed to a chair that is reconfigurable between a folded configuration for storage and an unfolded configuration for supporting an individual above a support surface. The chair includes a first leg having a first end for supporting the chair on the support surface in the unfolded configuration and an opposite second end extending upwardly and rearwardly from the first end in the unfolded configuration. An intermediate portion is located between the first and second ends. A second leg has a first end for supporting the chair on the support surface in the unfolded configuration and an opposite second end that extends upwardly and forwardly from the first end in the unfolded configuration. An intermediate portion of the second leg is located between the first and second ends of the second leg. The intermediate portion of the second leg is pivotally connected to the intermediate portion of the first leg. A support member has a first end pivotally connected to the first leg and an opposite second end. A generally circular and tubular seat frame has a first part pivotally connected to the second end of the support member and a second part pivotally connected to the second end of the second leg. A seat is supported by an outer circumference of the seat frame. The second end of the support member is adjacent the first end of both the first and second legs in the folded configuration and, in the unfolded configuration, a distance from the second end of the support member to the support surface is further than a distance from the second end of the second leg to the support surface. The chair is generally flat with the legs and support member proximate the frame in the folded configuration.

BRIEF DESCRIPTION OF THE SEVERAL VIEWS OF THE DRAWINGS

The foregoing summary, as well as the following detailed description of preferred embodiments of the present invention, will be better understood when read in conjunction with the appended drawings. For the purpose of illustrating the invention, there are shown in the drawings two embodiments which are presently preferred. It should be understood, however, that the invention is not limited to the precise arrangements and instrumentalities shown.

In the drawings.

DETAILED DESCRIPTION OF THE INVENTION

Figure 1:
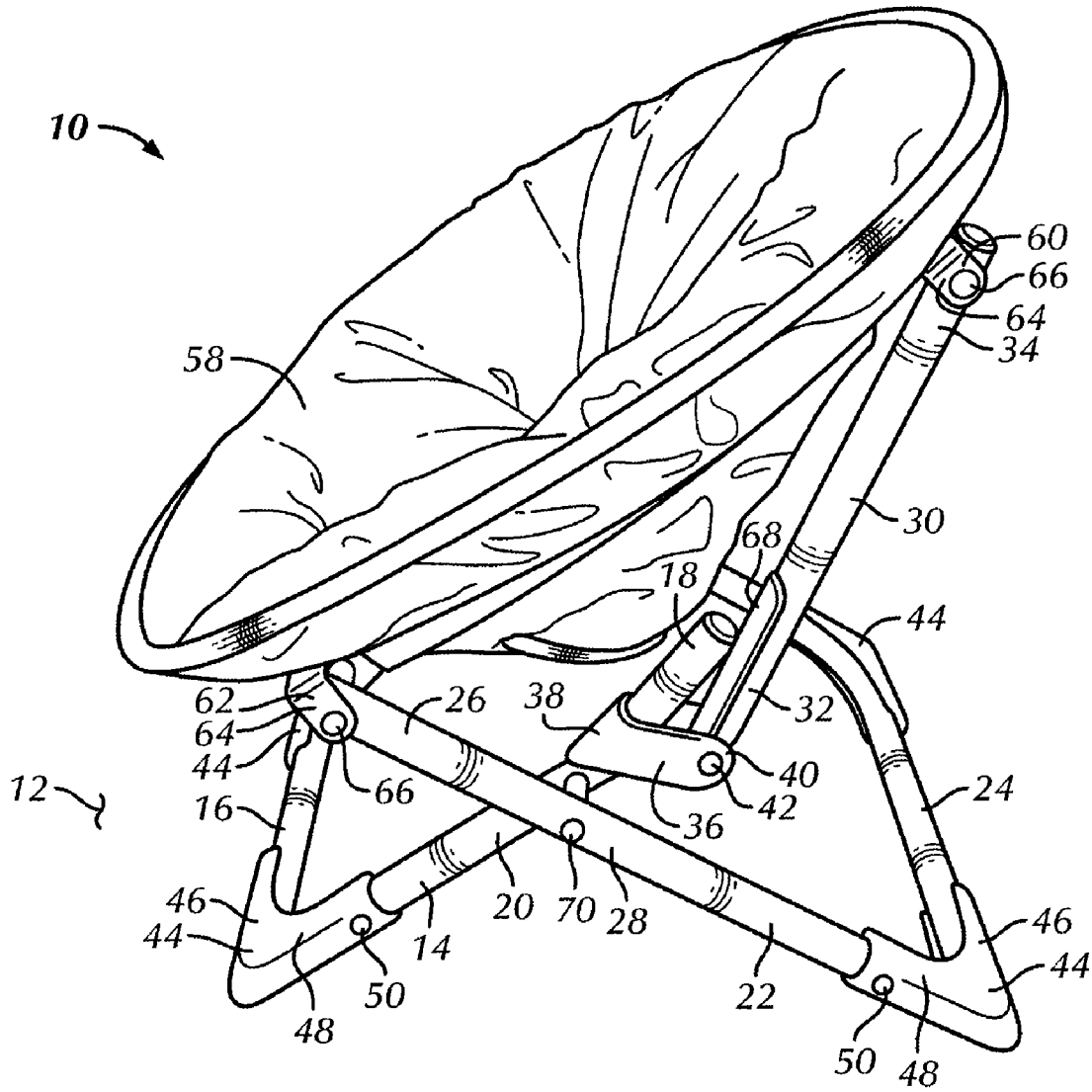
FIG. 1 is left side perspective view of a foldable chair in a unfolded configuration in accordance with a first preferred embodiment of the present invention.

Certain terminology is used in the following description for convenience only and is not limiting. The words "right", "left", "lower" and "upper" designate directions in the drawings to which reference is made. The words "inwardly" and "outwardly" refer to directions toward and away from, respectively, the geometric center of the chair in accordance with the present invention, and designated parts thereof. Unless specifically set forth herein, the terms "a", "an" and "the" are not limited to one element but instead should be read as meaning "at least one." The terminology includes the words noted above, derivatives thereof and words of similar import.

Figure 2:
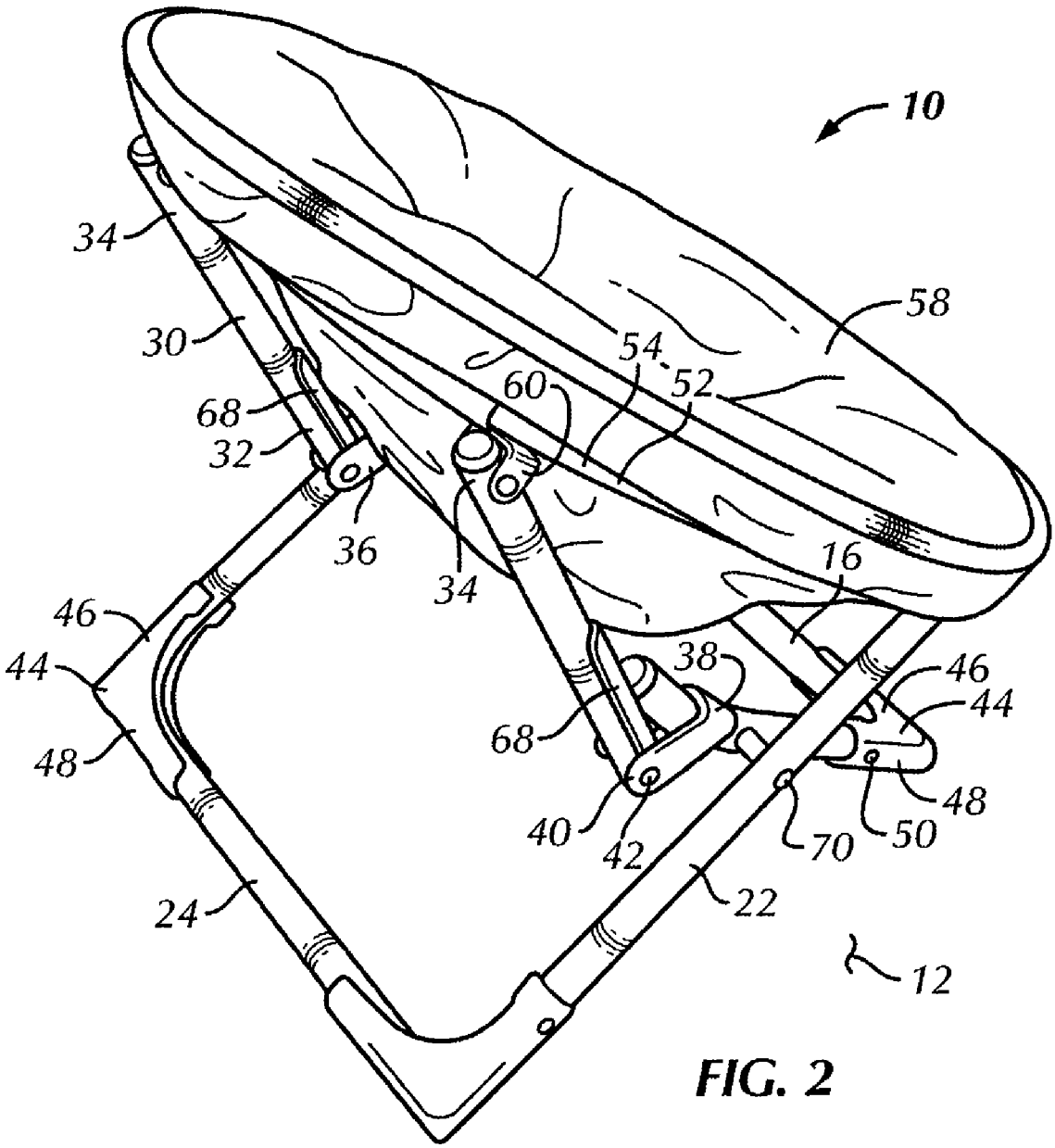
FIG. 2 is right side perspective view of the chair shown in FIG. 1, with the chair being in the unfolded configuration.

Referring to the drawings in detail, wherein like numerals indicate like elements throughout, there is shown in FIGS. 1-4 a foldable chair, generally designated 10, in accordance with a first preferred embodiment of the present invention. Preferably, the chair 10 is reconfigurable between a first or folded configuration (FIG. 4) for storage, displacement and/or transport and a second or unfolded configuration (FIGS. 1 and 2) for supporting an individual above a support or ground surface 12. Between the fully folded and fully unfolded configurations, the chair 10 includes a range of intermediate or partially folded/unfolded configurations, an example of one being shown in FIG. 3. However, it is understood by those of ordinary skill in the art that the chair 10 is not limited to being foldable, but may be locked in a single configuration and/or configured to have only a permanent open or unfolded use position (FIGS. 1 and 2).

Referring to FIGS. 1-4, the chair 10 includes a first leg 14 having a first or lower end 16 for supporting the chair 10 on the support surface 12 in the unfolded configuration and an opposing second or upper end 18 extending upwardly and rearwardly from the first end 16 in the unfolded configuration. The first leg 14 further includes an intermediate portion 20 located between the first and second ends 16, 18.

In the preferred embodiment, the chair 10 further includes a second leg 22 having a first or lower end 24 for supporting the chair 10 on the support surface 12 in the unfolded configuration and an opposite second or upper end 26 extending upwardly and forwardly from the first end 24 in the unfolded configuration. The second leg 22 further includes an intermediate portion 28 generally located between the first and second ends 24, 26 of the second leg 22. The intermediate portion 28 of the second leg 22 is preferably pivotally connected, by a pin 70, for example, to the intermediate portion 20 of the first leg 14.

Referring again to FIGS. 1-4, the chair 10 further includes a support member or bar 30, which has a first or lower end 32 pivotally connected to at least a portion of the first leg 14 and an opposite second or upper end 34. A bracket or joint 36 preferably pivotally connects at least a portion of the first leg 14 to the support member 30. Specifically, a first end 38 of the bracket 36 preferably surrounds at least a portion of the first leg 14 between the intermediate portion 20 and the second end 18 thereof. A second end 40 of the bracket 36 is preferably pivotally connected to the support member 30 proximate the first end 32 thereof. The first and second ends 38, 40 of the bracket 36 are preferably spaced-apart at a predetermined distance, preferably approximately 2 or 2½ inches apart. In the preferred embodiment, the first end 38 of the bracket 36 is fixedly and permanently secured to the first leg 14, such as by welding, and a pin 42 pivotally attaches the second end 40 of the bracket 36 to the support member 30.

In the preferred embodiment, the first and second legs 14, 22 and the support member 30 are generally tubular and hollow in shape and are formed of a light weight, high strength material, such as a rigid metallic material, like steel, aluminum or alloys thereof. However, it is within the spirit and scope of the present invention that the first and second legs 14, 22 and the support member 30 may be formed of any material and have any shape suitable for performing the functions described herein. The first and second legs 14, 22 and the support member 30 preferably have a constant and generally equal cross-sectional diameter D along their entire length.

As seen in FIGS. 1 and 2, in the unfolded configuration, at least a portion of the second end 18 of the first leg 14 directly contacts and/or abuts a portion of the support member 30. This contact provides increased support and rigidity to the chair 10 in the unfolded configuration such that the chair 10 is capable of supporting a wide range of sizes and/or weights of individuals above the support surface 12. However, it is understood by those of ordinary skill in the art that the first leg 14 is not limited to directly contacting the support member 30 in the unfolded configuration, as the second end 18 of the first leg 14 may be spaced a predetermined distance from the support member 30 in the unfolded configuration of the chair 10. A portion of the support member 30 may include a pad or cover 68 around or proximate to the point where the first leg 14 directly contacts the support member 30 to provide protection for the support member 30 and provide the support member 30 with additional rigidity.

Figure 3:
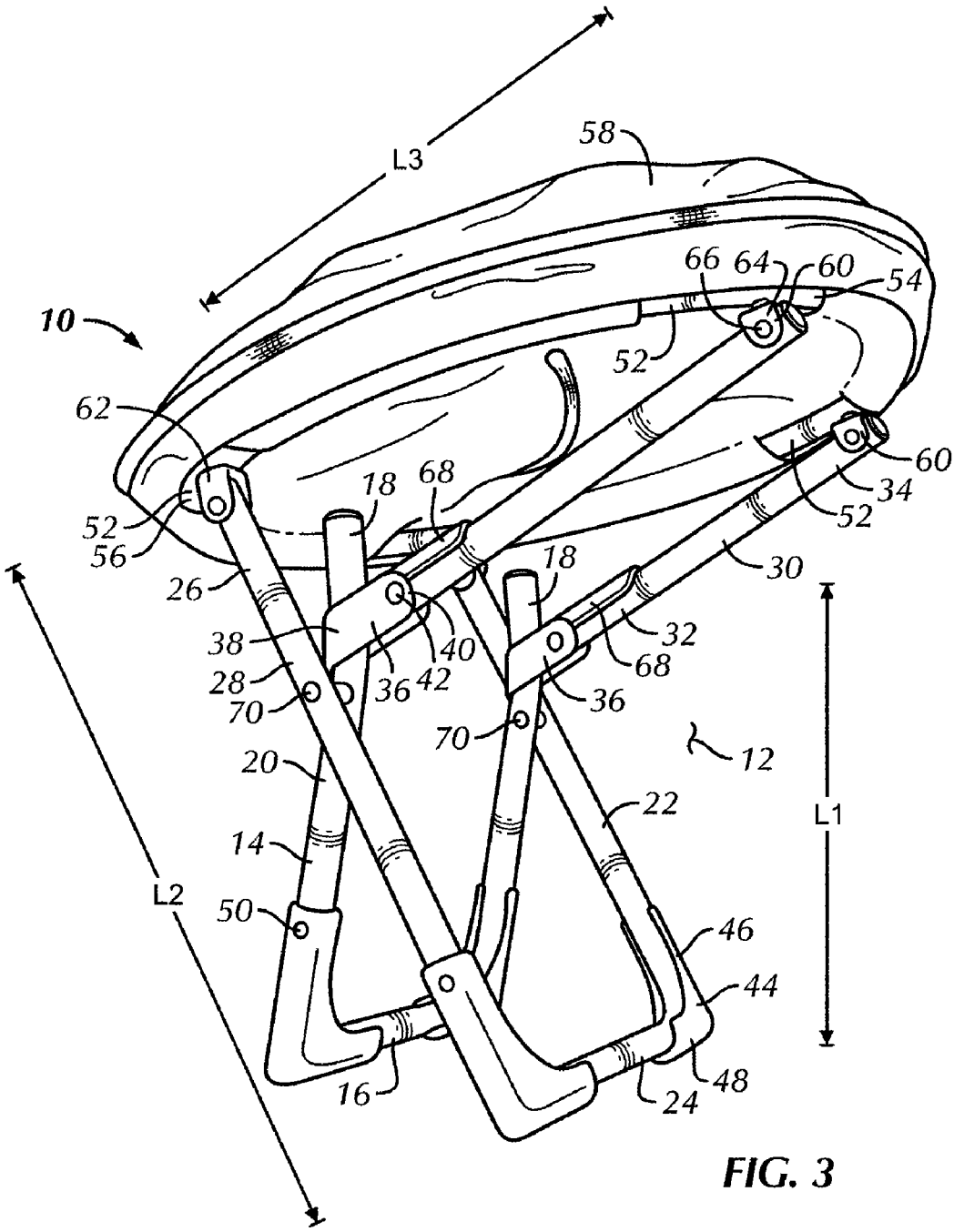
FIG. 3 is a left side perspective of the chair shown in FIG. 1, with the chair being in an intermediate configuration.
Figure 4:
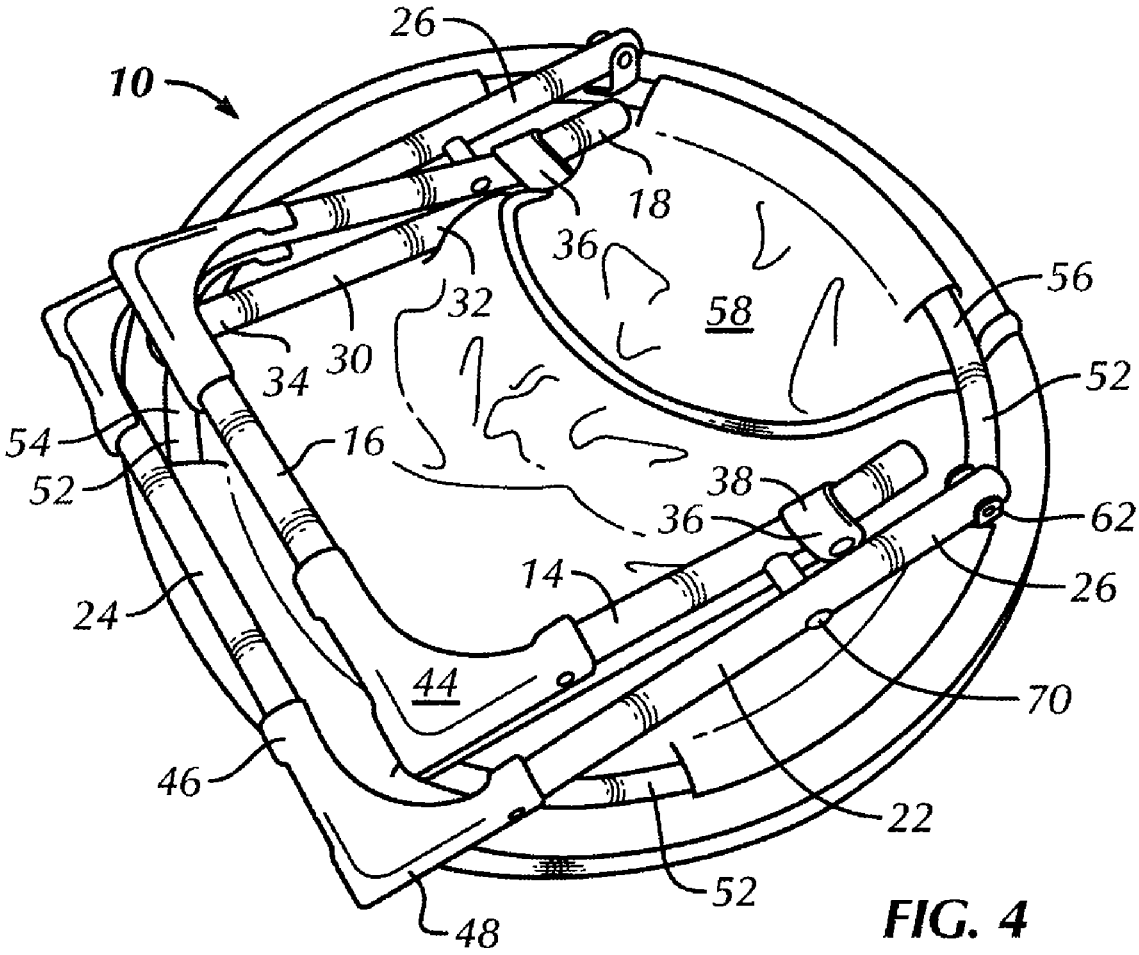
FIG. 4 is a bottom perspective view of the chair shown in FIG. 1, with the chair being in a folded configuration.

As seen in FIGS. 1, 3 and 4, in the present embodiment a length $L_2$ of the second leg 22 is longer than a length $L_1$ of the first leg 14, which is longer than a length $L_3$ of the support member 30. Specifically, the length $L_1$ of the first leg 14, as measured from the first end 16 to the second end 18 thereof, is preferably approximately 12 inches. The length $L_2$ of the second leg 22, as measured from the first end 24 to the second end 26, in the present embodiment is approximately 15 inches. Further, the length $L_3$ of the support member 30, as measured from the first end 32 to the second end 34 thereof, in the present embodiment is approximately 11 inches. However, it is understood by those of ordinary skill in the art that the lengths of any one of or all three of the first leg 14, second leg 22 and support member 30 may be modified without departing from the spirit and scope of the present invention. For example, the first leg 14, second leg 22 and support member 30 may be sized to support a relatively small individual, such as a child, or to support a larger individual, such as an adult.

Referring to FIGS. 1-3, preferably the support member 30 is generally straight or linear along its entire length $L_3$ and the first and second legs 14, 22 are generally non-linear. Specifically, in the preferred embodiment, the first and second legs 14, 22 are both generally u-shaped. The first ends 16, 24 of each leg 14, 22 generally form the bottom or base of the "U" shape, while second ends 18, 26 of each leg 14, 22 generally form the top or free end of the "U" shape. The intermediate portion 20, 28 of each leg 14, 22 generally connects the first ends 16, 24 to the second ends 18, 26 of each leg 14, 22. However, it is understood by those of ordinary skill in the art that the legs 14, 22 and support member 30 are not limited to such a configuration, as the chair 10 may include two spaced-apart first legs 14 and second legs 22, wherein the first end 16, 24 of each is not integral and/or connected. Further, as seen in FIGS. 1-3, the first leg 14 preferably includes a bend or angled portion, such that at least at portion of the intermediate portion 20 extends at a different angle from a portion of the second end 18. Specifically, the bend or angled portion of the first leg 14 is preferably located between the point where the intermediate portion 20 of the first leg 14 is attached to the intermediate portion 28 of the second leg 22 and second end 18.

Referring again to FIGS. 1-4, the chair 10 preferably includes at least two spaced-apart scratch-guards 44 removably mountable to a portion of the first end 16, 24 of both the first and second legs 14, 22. Specifically, each scratch-guard 44 includes a first portion 46 having a generally C-shaped cross-section that extends generally perpendicularly from a second portion 48 that has a generally C-shaped cross-section. The scratch-guards 44 provide increased traction and/or friction on the support surface 12 such that the chair 10 is less likely to inadvertently slide across the support surface 12. The scratch-guards 44 also protect the portions of the legs 14, 22 which engage the support surface 12. The scratch-guards 44 are preferably formed of a light weight, high strength material, such as a polymeric material, but the scratch-guards 44 are not limited to the above-identified size, shape or material. Preferably, one or more fasteners, 50, such as a screw, removably attach the scratch-guards 44 directly to a portion of the legs 14, 22.

In the preferred embodiment, and as shown in FIGS. 2-4, the chair 10 includes a seat frame 52 having a first or rear part 54 pivotally connected to the second end 34 of the support member 30 and an opposite second or front part 56 pivotally connected to the second end 26 of the second leg 22. The seat frame 52 is generally circular or ovular in shape when viewed from above or below (FIG. 4). The seat frame 52 is generally tubular and preferably hollow in shape and supports a seat 58, preferably padded, around substantially an entire outer circumference thereof. However, it is understood that the seat 58 may be attached only to portions of the seat frame 52 and the seat 58 may either be permanently or removably attached to the seat frame 52, such as by Velcro straps or stitched loops through which the seat frame 52 extends.

As seen in FIGS. 1 and 3, a pair of rear pivot seats 60 and a pair of front pivot seats 62 are fixedly attached to a bottom side of the seat frame 52 at two lateral sides of the first and second parts 54, 56 of the seat frame 52. Each of the front and rear pivot seats 62, 60 has a parallel pair of downwardly extending pivot lobes 64. The second end 34 of the support member 30 and the second end 26 of the second leg 22 extend between the pivot lobes 64 of a respective one the front and rear pivot seats 62, 60. The second end 34 of the support member 30 and the second end 26 of the second leg 22 are each connected pivotally to one of the respective pivots seats 62, 60 by a pin 66 that extends transversely through the pivot lobes 64.

In the unfolded configuration (FIGS. 1 and 2), the first part 54 of the seat frame 52 is generally higher or further from the support surface 12 than the second part 56, such that the seat frame 52 is angled from back to front with respect to the support surface 12. In the folded configuration (FIG. 4), the second end 34 of the support member 30 is preferably next to or adjacent the first end 16, 24 of both the first and second legs 14, 22. Furthermore, in the unfolded configuration, a distance from the second end 34 of the support member 30 to the support surface 12 is preferably further than a distance from the second end 26 of the second leg 22 to the support surface 12.

In operation, there may be several possible ways to reconfigure the chair from the unfolded configuration to the folded configuration. For example, a preferred method of folding the chair 10 includes taking the fully unfolded chair 10 (FIGS. 1 and 2), where the second end 18 of the first leg 14 is in abutting contact or nearly abutting contact with the support member 30, and inverting it such that the seat frame 52 extends flush with and parallel to the support surface 12, where the legs 14, 22 and support member 30 extend upwardly and away from the support surface 12. A user may then hold at least a portion of the seat frame 52, for example, firmly against the support surface 12 and grasp a portion of the first leg 14, preferably the first end 16 of the first leg 14. With the seat frame 52 held against the support surface 12, the user may pivot the first end 16 of the first leg 14, with one hand, for example, toward the first or rear part 54 of the seat frame 52. This motion of the first leg 14 causes the second end 18 of the first leg 14 to rotate toward the second or front part 56 of the seat frame 52 and causes the first end 24 of the second leg 22 to rotate toward the first or rear part 54 of the seat frame 52. Continuing this motion causes the legs 14, 22 and the support member 30 to move into the fully folded configuration (FIG. 4), where the chair 10 is generally flat with the legs 14, 22 and the support member 30 close to the seat frame 52 and proximate to a plane generally parallel to a plane defined by the seat frame 52.

Figure 5:
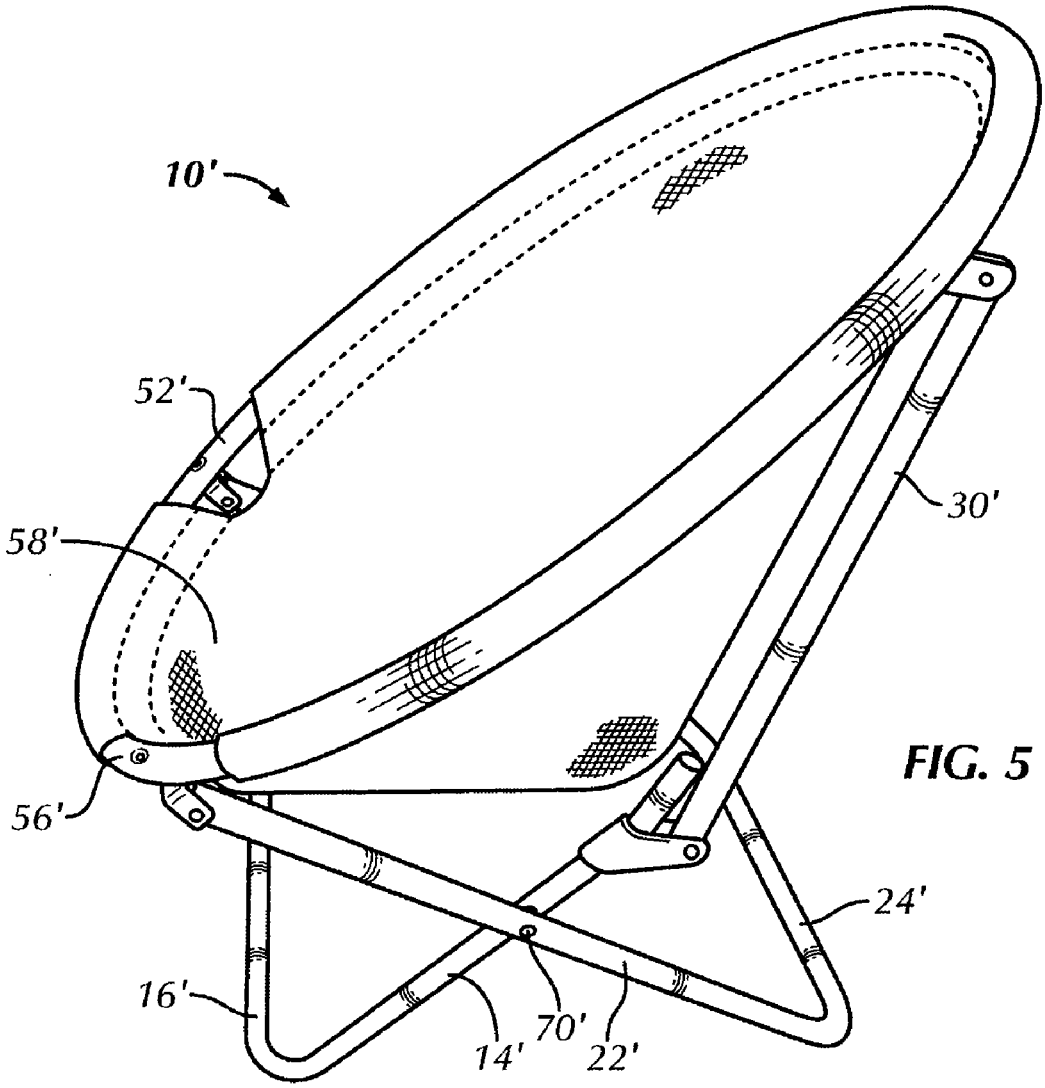
FIG. 5 is a left side perspective view of a foldable chair in a unfolded configuration in accordance with a second preferred embodiment of the present invention.
Figure 6:
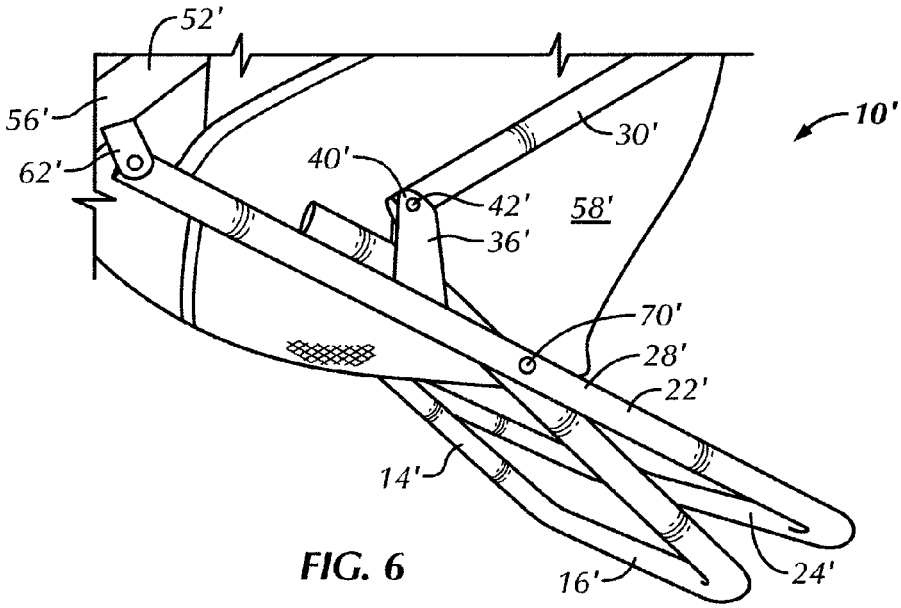
FIG. 6 is a left side perspective of the chair shown in FIG. 5, with the chair being in an intermediate configuration.
Figure 7:
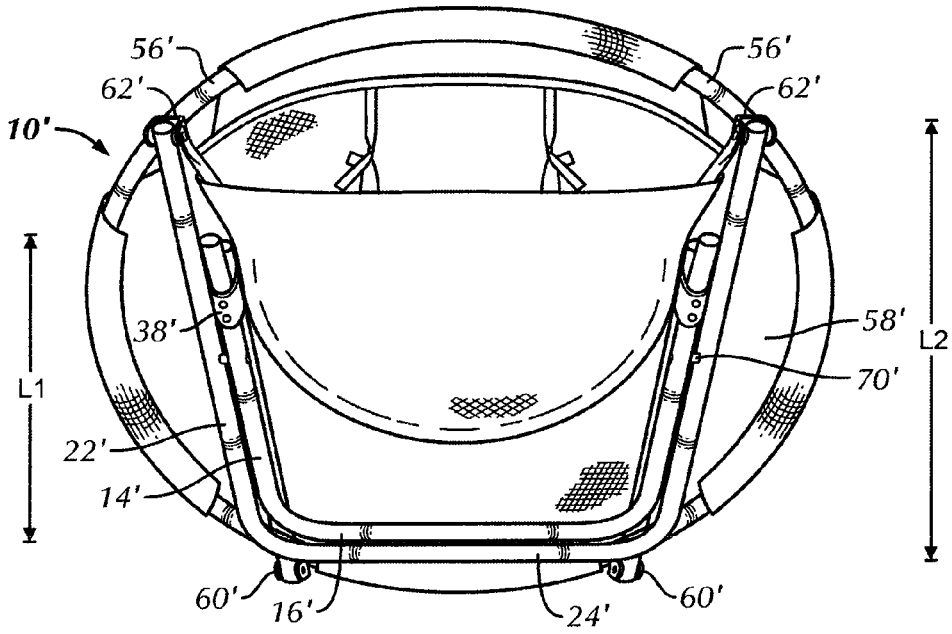
FIG. 7 is a bottom perspective view of the chair shown in FIG. 5, with the chair being in a folded configuration.

Referring to FIGS. 5-7, a second preferred embodiment of the chair 10' is shown, wherein like numerals are utilized to identify like elements and a prime symbol (') is utilized to distinguish like components of the chair 10' of the second preferred embodiment from the chair 10 of the first preferred embodiment. The chair 10' of the second preferred embodiment is substantially similar in structure and operation to the chair 10 first preferred embodiment described above. Therefore, for the sake of brevity, detailed discussion of the chair 10' of the second preferred embodiment is omitted herein. However, one difference is that the chair 10' is specifically designed to accommodate a larger individual, such as a full-grown adult, such that the lengths $L_1'$, $L_2'$, $L_3'$ of the first and second legs 14', 22' and the support member 30', respectively, are noticeably longer than the lengths $L_1$, $L_2$, $L_3$ described above. For example, the length $L_1'$ of the first leg 14', as measured from the first end 16' to the second end 18' thereof, may be approximately 24 inches and the remaining lengths $L_2'$, $L_3'$ may be modified accordingly. Also, the first leg 14' of the chair 10' generally fits entirely within the second leg 22' in the folded configuration (FIG. 7) and the entire first leg 14', with the exception of the bend or angled portion, extends parallel to the second leg 22' in the folded configuration (FIG. 7).

It will be appreciated by those skilled in the art that changes could be made to the embodiments described above without departing from the broad inventive concept thereof. It is understood, therefore, that this invention is not limited to the particular embodiment disclosed, but it is intended to cover modifications within the spirit and scope of the present invention as defined by the appended claims.

I claim:

1. A chair reconfigurable between a folded configuration for storage and an unfolded configuration for supporting an individual above a support surface, the chair comprising:

a first leg having a first end for supporting the chair on the support surface in the unfolded configuration, an opposite second end extending upwardly and rearwardly from the first end in the unfolded configuration and an intermediate portion between the first and second ends;

a second leg having a first end for supporting the chair on the support surface in the unfolded configuration, an opposite second end extending upwardly and forwardly from the first end in the unfolded configuration and an intermediate portion between the first and second ends, the intermediate portion of the second leg being pivotally connected to the intermediate portion of the first leg;

a support member having a first end pivotally connected to the first leg and an opposite second end; and a seat frame having a first part pivotally connected to the second end of the support member and a second part pivotally connected to the second end of the second leg;

wherein the second end of the support member is adjacent the first end of both the first and second legs in the folded configuration.

2. The chair according to claim 1, wherein the seat frame is generally circular and supports a seat.

3. The chair according to claim 1, further comprising:

a bracket pivotally connecting a portion of the first leg to the support member, a first end of the bracket surrounding a portion of the first leg between the intermediate portion and the second end, a second end of the bracket being pivotally connected to the support member proximate the first end thereof, the first and second ends of the bracket being spaced-apart at a predetermined distance.

4. The chair according to claim 3, wherein the first end of the bracket is permanently secured to the first leg and a pin pivotally attaches the second end of the bracket to the support member.

5. The chair according to claim 1, wherein, in the unfolded configuration, at least a portion of the second end of the first leg directly contacts a portion of the support member.

6. The chair according to claim 5, wherein the support member is generally linear and the first leg is generally nonlinear.

7. The chair according to claim 1, wherein the first end of both the first and second legs is generally U-shaped.

8. The chair according to claim 7, further comprising:

two spaced-apart scratch-guards removably mountable to a portion of the first end of both the first and second legs, wherein each scratch-guard includes a first portion having a generally C-shaped cross-section extending generally perpendicular to a second portion having a generally C-shaped cross-section.

9. A chair comprising:

a first leg having a first end for supporting the chair on a support surface in an unfolded configuration, an opposite second end extending upwardly and rearwardly from the first end in the unfolded configuration and an intermediate portion between the first and second ends;

a second leg having a first end for supporting the chair on the support surface in the unfolded configuration, an opposite second end extending upwardly and forwardly from the first end in the unfolded configuration and an intermediate portion between the first and second ends, the intermediate portion of the second leg being pivotally connected to the intermediate portion of the first leg;

a support member having a first end pivotally connected to the first leg and an opposite second end;

a bracket pivotally attaching a portion of the first leg to the support member, a first end of the bracket surrounding a portion of the first leg between the intermediate portion and the second end, a second end of the bracket pivotally connected to the support member proximate the first end thereof;

a seat frame having a first part pivotally connected to the second end of the support member and a second part pivotally connected to the second end of the second leg; and a seat supported by the seat frame;

wherein the chair is reconfigurable between a folded configuration for storage where the legs and support member are pivoted to be generally flat and proximate to a plane defined by the seat frame and the unfolded configuration for supporting an individual above the support surface, and wherein the second end of the support member is adjacent the first end of both the first and second legs in the folded configuration.

10. The chair according to claim 9, wherein the seat frame is generally circular and tubular.

11. The chair according to claim 10, wherein the seat is supported by an outer circumference of the seat frame.

12. A chair reconfigurable between a folded configuration for storage and an unfolded configuration for supporting an individual above a support surface, the chair comprising:

a first leg having a first end for supporting the chair on the support surface in the unfolded configuration, an opposite second end extending upwardly and rearwardly from the first end in the unfolded configuration and an intermediate portion between the first and second ends;

a second leg having a first end for supporting the chair on the support surface in the unfolded configuration, an opposite second end extending upwardly and forwardly from the first end in the unfolded configuration and an intermediate portion between the first and second ends, the intermediate portion of the second leg being pivotally connected to the intermediate portion of the first leg;

a support member having a first end pivotally connected to the first leg and an opposite second end;

a generally circular and tubular seat frame having a first part pivotally connected to the second end of the support member and a second part pivotally connected to the second end of the second leg; and a seat supported by an outer circumference of the seat frame;

wherein the second end of the support member is adjacent the first end of both the first and second legs in the folded configuration and, in the unfolded configuration, a distance from the second end of the support member to the support surface is further than a distance from the second end of the second leg to the support surface, and wherein the chair is generally flat with the legs and support member proximate the frame in the folded configuration.

* * * * *